US009392849B1

(12) United States Patent
Makhoulian et al.

(10) Patent No.: US 9,392,849 B1
(45) Date of Patent: Jul. 19, 2016

(54) MULTIFUNCTIONAL DECORATIVE JEWELRY ELEMENT

(71) Applicant: Richline Group, New York, NY (US)

(72) Inventors: Mossig H. Makhoulian, New York, NY (US); Ralph S. Rossini, New York, NY (US); Julie M. Lamb, New York, NY (US)

(73) Assignee: Richline Group, New York, NY (US)

( * ) Notice: Subject to any disclaimer, the term of this patent is extended or adjusted under 35 U.S.C. 154(b) by 0 days.

(21) Appl. No.: 14/560,875

(22) Filed: Dec. 4, 2014

Related U.S. Application Data

(60) Provisional application No. 61/914,545, filed on Dec. 11, 2013.

(51) Int. Cl.
*A44C 5/00* (2006.01)
*A44C 7/00* (2006.01)

(52) U.S. Cl.
CPC ..... *A44C 5/0007* (2013.01); *A44C 5/003* (2013.01); *A44C 7/003* (2013.01)

(58) Field of Classification Search
CPC ..... A44C 5/0007; A44C 5/003; A44C 7/003; A44C 15/001; A44C 15/003
USPC ..... 63/1.11, 12, 1.16, 1.17; 24/705
See application file for complete search history.

(56) References Cited

U.S. PATENT DOCUMENTS

| | | | | |
|---|---|---|---|---|
| 511,952 | A * | 1/1894 | Hubash | 606/188 |
| 4,630,452 | A * | 12/1986 | Connelly | A44C 7/003 24/108 |
| 5,099,659 | A | 3/1992 | Carranza et al. | |
| 5,411,516 | A * | 5/1995 | Thomas | A44C 7/001 606/188 |
| 6,539,749 | B2 * | 4/2003 | Gibbs, III | A44C 15/0055 63/1.11 |
| 6,594,871 | B2 | 7/2003 | Hoffman | |
| 7,216,508 | B2 | 5/2007 | Kretchmer | |
| 7,523,527 | B2 | 4/2009 | Garber | |
| 2008/0271296 | A1 | 11/2008 | Jepsen | |
| 2013/0160489 | A1 | 6/2013 | Arjang et al. | |
| 2013/0269389 | A1 | 10/2013 | Spadaro | |

FOREIGN PATENT DOCUMENTS

| | | |
|---|---|---|
| CN | 200944894 | 9/2007 |
| CN | 202286636 | 7/2012 |
| CN | 202923173 | 5/2013 |
| DE | 10138989 | 2/2002 |
| EP | 0271423 | 6/1988 |
| KR | 20050032633 | 4/2005 |
| WO | WO2006086311 | 8/2006 |
| WO | WO2007034470 | 3/2007 |

* cited by examiner

*Primary Examiner* — Abigail Morrell
(74) *Attorney, Agent, or Firm* — Levisohn Berger LLP

(57) ABSTRACT

A pierced earring may also be used to decorate an end cap of a bangle or bracelet in which the end cap has an aperture through which the post of the earring is slid with the end cap holding the pierced earring decorative head in place thereby providing an additional environment in which the pierced earring may serve a decorative purpose.

7 Claims, 4 Drawing Sheets

MULTIFUNCTIONAL DECORATIVE JEWELRY ELEMENT

RELATED APPLICATIONS

This application claims the priority of provisional patent application Ser. No. 61/914,545, filed Dec. 11, 2013, the substance of which is incorporated herein.

BACKGROUND OF THE INVENTION

The invention relates to a decorative element which can be used as an end piece for bracelets or other jewelry elements as well as a stud earring for pierced ears.

An area of the jewelry industry which has been growing is that in which jewelry may serve multifunctional purposes. Such an effort has been made because of the desire to reduce the ultimate cost of jewelry yet provide interesting and different decorative jewelry items using some of the same elements.

Earrings for pierced ears include a decorative element attached to a pin or post and an earring back which attaches the decorative element in the front of the post to the ear with the pin or post passing through the hole in a pierced ear and being snugly attached to the ear by an earring back.

The range in variety of jewelry serving as earrings for pierced ears is very broad.

The inventors recognize that a multifunctional jewelry element can be provided which can serve both as an earring for pierced ears and an end or other decoratively located element to decorate another jewelry item, such as a bracelet, pendant or the like. The multifunctional utilization of decorative jewelry elements having a post extending therefrom is achieved by utilizing magnetic attraction to hold the decorative element in an aperture of a jewelry item other than an earring, yet be able to also use the post of the earring for conventional pierced earrings. In another embodiment, a friction fit anchor located within the bracelet or pendant can capture and hold the decorative end element by capturing and holding the pin or post of the earring with or without magnetic attraction.

The invention will be more fully understood with reference to the figures of the invention attached hereto.

DETAILED DESCRIPTION

While this invention is illustrated with use of button pearls as the decorative earring element, any suitable decorative jewelry item which can be held on the end of a pierced earring and be mounted in the jewelry bangle to hold the decorative element will be suitable. Additionally, while the invention is illustrated with a bracelet or bangle, the decorative elements conventionally used for earrings could be used with any other jewelry article having sufficient depth to receive and hold the post. The post may be held in the bangle by friction, magnetic means or a combination of both.

Figure 1:
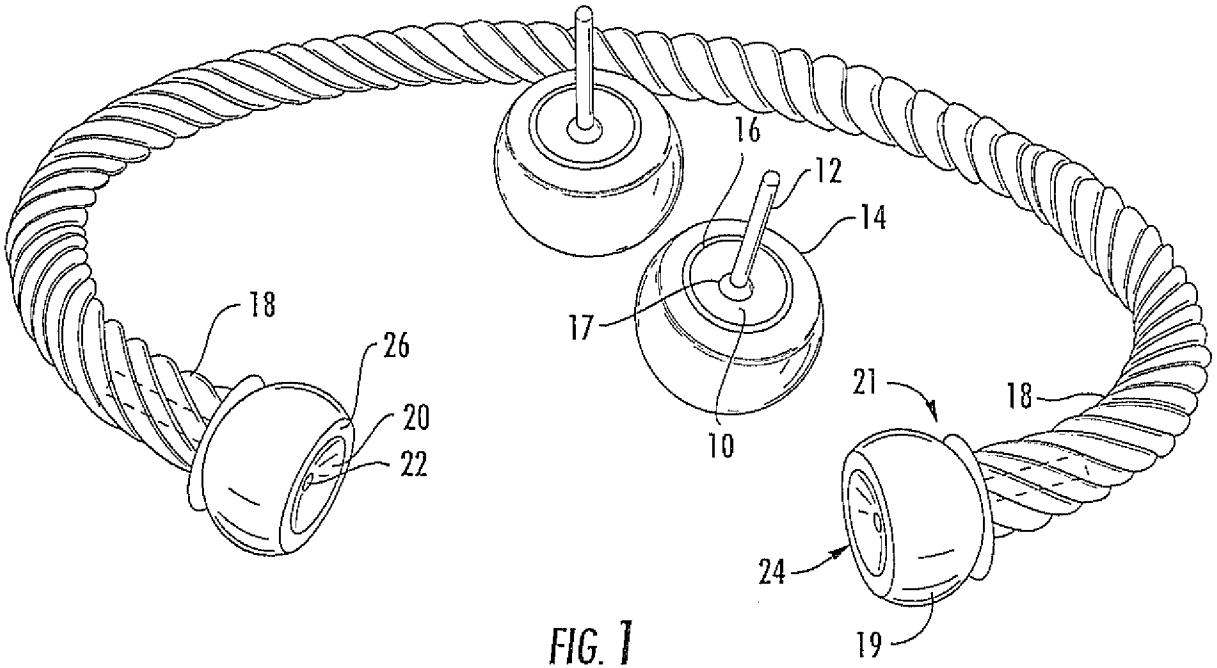
FIG. 1 is a perspective view of a first embodiment of earrings with posts for pierced ears and a bracelet having apertures at their free ends to receive the posts with the earring and free ends attracted to each other by magnetism.

Referring to FIG. 1, a rear portion of the decorative button pearl element 14 has an annular recess 16 into which an annular magnet 10 may be attached. Alternatively, magnet 10 may merely be comprised of a metal capable of being attracted to a magnet. Post 12 integrally formed with button pearl 14 extends rearwardly therefrom with an annular collar 17 on post 12 to secure the post. Magnet 10 or some other magnetically attracted metal is set into recess 16 and may be held there by suitable adhesive or other adhering means. Such button pearls may be used in the conventional manner as pierced earrings by attaching the post 12 to a conventional earring back in the conventional fashion.

A bracelet or bangle 18 has end pieces 19 located at the free ends 21 of the bracelet. As normally worn, bracelet 18 has its free ends 21 separated from each other to permit the wearer to slip the bracelet on or take it off. End pieces 19 have a circular magnet 20 with a center aperture 22 attached in the end faces 24 of the bangle 18. Magnet 20 is securely attached in annular recesses 26 formed at the end faces 24 of the bangle to ensure firm attachment of magnet 20 to the bangle end.

The multifunctional decorative element 14 serves both as a decorative end for the bracelet or bangle of FIG. 1 as well as serving as a standard earring for pierced ears.

Additionally, instead of using two magnetic elements 10 and 20, only one magnetic element may be needed so long as the other element is magnetically attracted thereto.

As stated above, other decorative elements could be used in association with the magnet mounted on the post and the decorative elements could be utilized with other items of jewelry which can accommodate a traditional post length for insertion into an aperture to be magnetically held or held by friction.

The embodiment of FIG. 1 discloses magnetically holding pin 12 in end cap 19 of bangle or bracelet 18. An alternative embodiment not employing magnetic attraction is disclosed in FIGS. 2 and 4, and an embodiment combining the embodiments of FIGS. 1-4 is also within the teachings of this invention.

Figure 2:
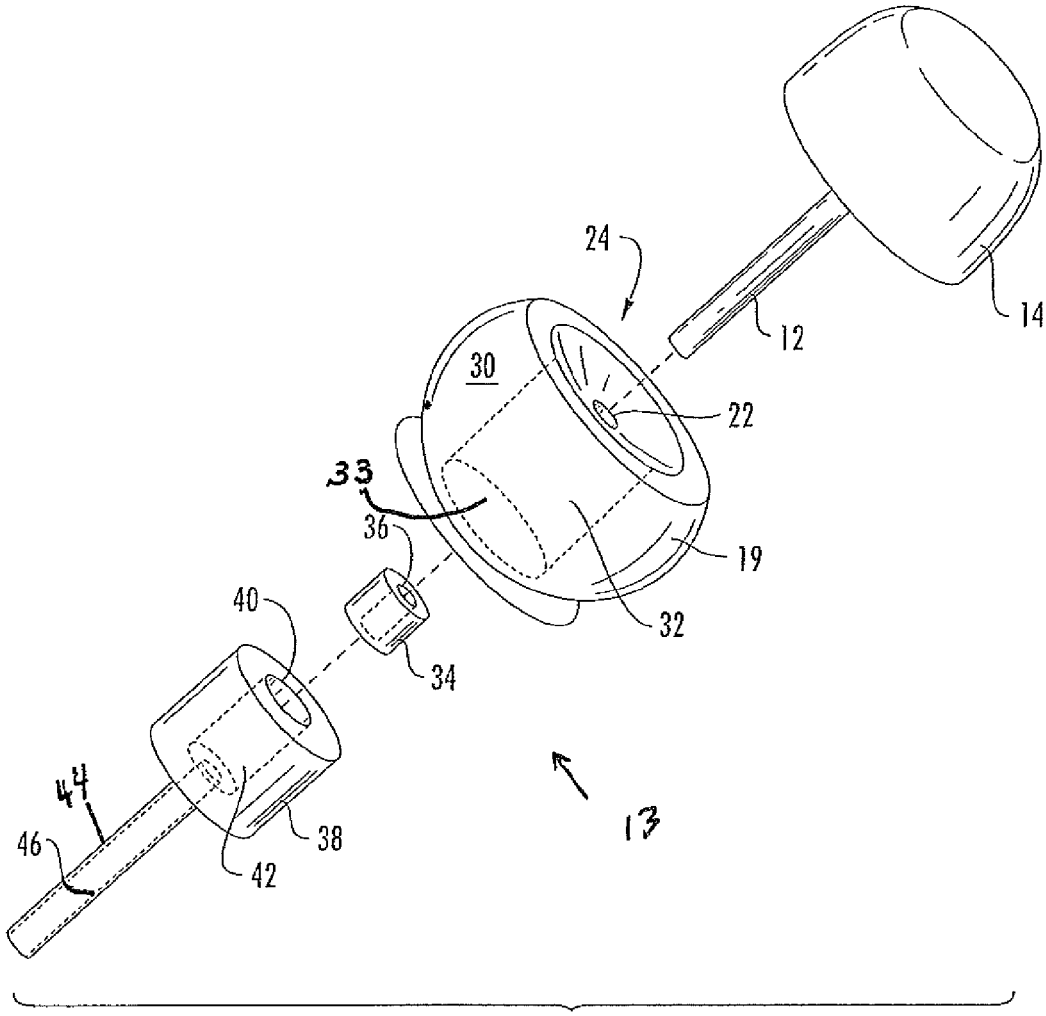
FIG. 2 is an exploded perspective view of another embodiment of the earring being inserted into a bangle end and being held by friction.
Figure 3:
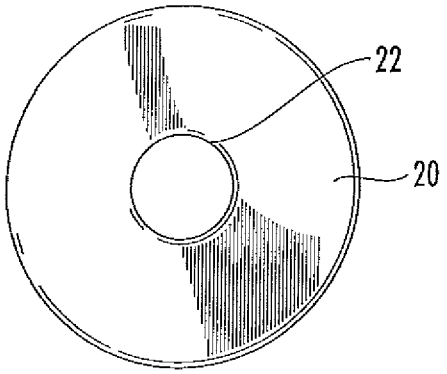
FIG. 3 is a plan view of a magnet to be attached to a bangle end.
Figure 4:
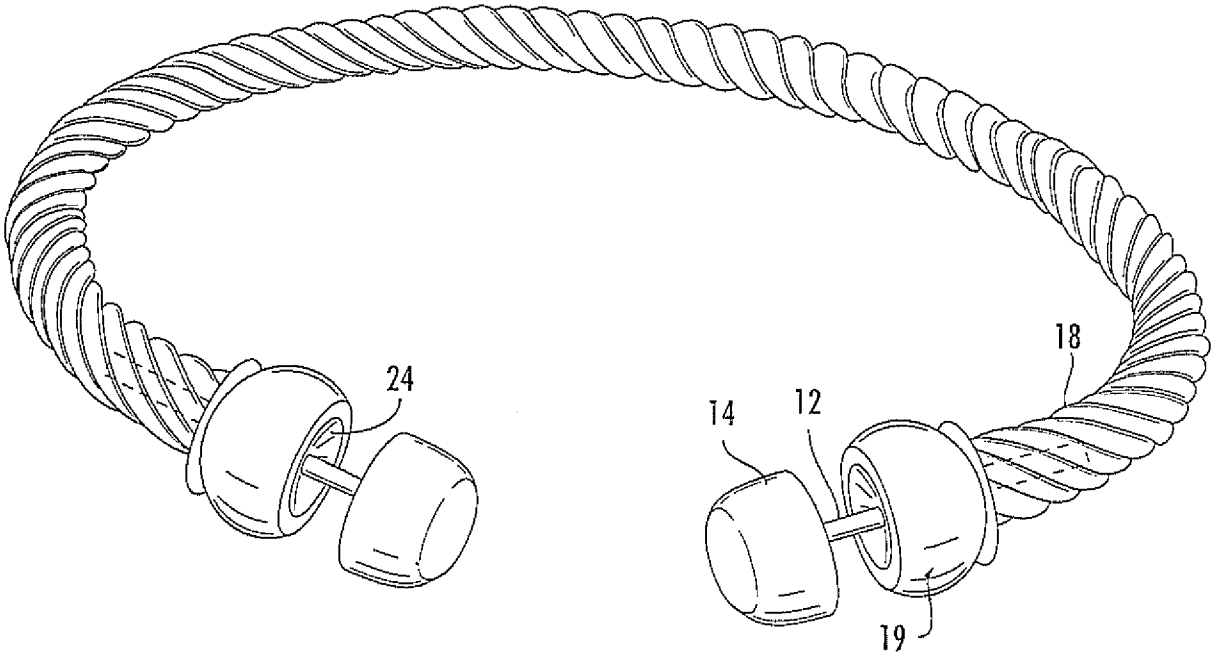
FIG. 4 is a perspective view showing the earrings being inserted into the ends of the bracelet.

FIG. 2 is an exploded perspective view which shows a pierced earring 14 with pin 12 inserted in aperture 22 in front face 24 of end cap 19. Pin 12 is inserted in a receptacle 13 formed of a plurality of axially aligned holding elements to receive and hold the pin 12. Receptacle 13 includes an end cap 19 had which has an end cap body 30 which has a cylindrical bore 32 therethrough. Bore 32 is axially aligned with aperture 22 of the end cap. A silicone sleeve 34 also has a bore 36 therethrough axially aligned with the axial bore 32 in recess 33 and aperture 22. Sleeve 34 may be silicone or some other rubber type material, and the bore 36 essentially located therein is sized to allow pin 12 to frictionally slide therethrough but to hold pin 12 frictionally in sleeve 34. Sleeve 34 fits within a cylindrical capture member 38 having a central bore 40 axially aligned with bores 36, 32 and aperture 22. Bore 40 is slightly larger and accommodates cylindrical sleeve 34 with the cylindrical sleeve 34 captured in an axially aligned cylindrical recess 42 in cylindrical capture member 38. Capture member 38 holds silicone sleeve 34 and slides into and is held in bore 32 of end cap body 30.

A docking shaft 44 extends further inwardly from capture member 38 and is integrally attached to cylindrical head 42, with docking shaft 44 having a bore 46 therethrough axially aligned with bores 36 and 32 and aperture 22.

Pierced earring 14 is captured by and held in end cap 19 with pin 12 passing through aperture 22, bore 32 through end cap body 19, bore 36 through silicone sleeve 34 and bore 42 in cylindrical head 38 with pin 12 thereby resting within capture shaft 44.

The relatively small size of silicone shaft enables the shaft to be held in place in recess 32 yet be short enough permitting relatively passage of pin 12 into docking shaft 46. Silicone sleeve 34 thereby holds pin 12 in place because it bears on the pin 12 when the pierced earring 14 is inserted within the free end of end cap 19.

As described above, front face 24 in FIGS. 2 and 4 need not be of magnetic material since silicone sleeve 34 provides enough friction to hold pin 12 in place. On the other hand, one could have a combination of annular magnet 20 fitting in recess 26 thereby further holding pierced earring 14 in place with the pierced earring itself either having a magnetic member as at 10 or a metal attracted to magnet 20 in end cap 19.

It should be understood that the preferred embodiment was described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly legally and equitably entitled.

The invention claimed is:

1. A jewelry bracelet having free ends separated from each other, said jewelry bracelet comprising:

a pierced earring comprising a pin attached to a decorative end piece, at least one of said free ends comprising a receptacle, said receptacle comprising:

an end cap having a front face with a central aperture and a rear recess, a cylindrical sleeve comprising an axial bore therethrough, the axial bore of said cylindrical sleeve being axially aligned with said central aperture, and being of substantially the same diameter, said cylindrical sleeve being located and held in said rear recess, said pin of said decorative end piece being cylindrical and of a diameter substantially similar to said central aperture of said front face and said axial bores of said cylindrical sleeve, said pin sliding through said central aperture and passing through said cylindrical sleeve, said cylindrical sleeve frictionally holding said pin of said decorative end piece in place.

2. The jewelry bracelet according to claim 1, wherein said front face comprises a magnet held in said front face, said decorative end piece magnetically attracted to and held by said magnet in said front face.

3. The jewelry bracelet according to claim 1, wherein said sleeve comprises a rubbery material to receive and hold said pin.

4. The jewelry bracelet according to claim 3, wherein said rubbery material comprises silicone.

5. The jewelry bracelet according to claim 3, further comprising a magnet held in said front face of said end cap, said decorative end piece magnetically attracted to and held by said magnet.

6. The jewelry bracelet according to claim 1, wherein said receptacle further comprises a cylindrical head attached to a docking shaft, said cylindrical head holding said cylindrical sleeve, said pin inserted in said receptacle and located within said docking shaft when said pin is inserted in said receptacle.

7. The jewelry bracelet according to claim 6, wherein said cylindrical head comprises a bore axially aligned with said axial bore of said cylindrical sleeve, said cylindrical sleeve inserted and held in said bore of said cylindrical head.

* * * * *